US005426869A

United States Patent [19]

Gore et al.

[11] Patent Number: 5,426,869

[45] Date of Patent: Jun. 27, 1995

[54] WATERPROOF SHOE AND INSOLE STRIP

[75] Inventors: Scott A. Gore, Hockessin; David T. Zador, Newark, both of Del.

[73] Assignee: W. L. Gore & Associates, Inc., Newark, Del.

[21] Appl. No.: 252,372

[22] Filed: May 16, 1994

Related U.S. Application Data

[63] Continuation of Ser. No. 79,471, Jun. 17, 1993, abandoned.

[51] Int. Cl.[6] ..... A43B 13/02

[52] U.S. Cl. ..... 36/22 R; 36/12; 36/30 R; 12/142 T

[58] Field of Search ..... 36/12, 84, 22, 23, 85, 36/30 R; 12/142 RS, 142 T, 145

[56] References Cited

U.S. PATENT DOCUMENTS

| | | | |
|---|---|---|---|
| 656,472 | 8/1900 | Reed | 36/30 R |
| 1,801,379 | 4/1931 | Turner | 36/30 R |
| 2,347,740 | 5/1944 | Hill . | |
| 3,778,251 | 12/1973 | Trask | 36/68 X |
| 3,807,061 | 4/1974 | Krus et al. | 36/30 R X |
| 3,951,919 | 4/1976 | Pinfold | 12/145 X |
| 4,599,810 | 7/1986 | Sacre . | |
| 4,819,345 | 4/1989 | Mulcahy et al. . | |
| 4,858,340 | 8/1989 | Pasternak | 36/12 X |
| 4,946,535 | 8/1990 | Meckel et al. | 12/142 T X |

FOREIGN PATENT DOCUMENTS

| | | | |
|---|---|---|---|
| 0133078 | 10/1947 | Australia | 36/12 |
| 0143226 | 6/1950 | Australia | 36/30 |
| 420396 | 1/1911 | France . | |
| 0366435 | 1/1923 | Germany | 36/30 R |
| WO9112740 | 9/1991 | WIPO . | |

OTHER PUBLICATIONS

Patent Abstracts of Japan—vol. 14, No. 310—4 Jul. 1990 JP,A,02 107 203 (Nogawa).

*Primary Examiner*—Paul T. Sewell
*Assistant Examiner*—Ted Kavanaugh
*Attorney, Agent, or Firm*—Gary A. Samuels

[57] ABSTRACT

A waterproof shoe gasket insole strip comprising a stiff textile material gasket sheet coated with a selected thermoplastic polymer. The insole gasket is located between the insole and the outer sole. Due to its stiff, but flexible nature, it is easy to apply during lasting procedures.

1 Claim, 3 Drawing Sheets

WATERPROOF SHOE AND INSOLE STRIP

This application is a continuation, of application Ser. No. 08/079,471 filed Jun. 17, 1993 now abandoned.

FIELD OF THE INVENTION

This invention relates to waterproof shoes and boots and to a new and useful waterproof insole gasket strip.

BACKGROUND OF THE INVENTION

In shoe constructions in which waterproof breathable uppers are used, it is convenient to attach the combination to an insole. But due to construction and cost considerations, it is not feasible to bring the upper and liner across the bottom of the shoe. Accordingly, an insole supplement, frequently called an insole gasket, is used to bridge the area not covered by the combination, and to provide a waterproof buffer between the insole and the outer sole. However, it is difficult to bond across the opening. Many gasket materials tend to wrinkle during bonding. Others are too limp and pliant. Many need to have adhesive applied thus creating a separate step. In addition to these requirements, the insole gasket needs to be waterproof.

It would be desirable to have a waterproof insole gasket that is flexible but stiff so that it can be easily positioned in place without wrinkling or become mis-shaped, that is strong but lightweight, that is self-adhering so that a separate adhesive need not be applied thus making use of solvent and means for solvent removal unnecessary.

SUMMARY OF THE INVENTION

In this invention an insole gasket strip has been found that meets these criteria. The insole strip of this invention comprises a strip of a stiff, flexible nonwoven polyester continuously coated with a thermoplastic.

Thus, the shoe of this invention comprises:

a) a waterproof upper adapted to extend partially under the foot;

b) an inner sole attached on its underside to the partial extension of the upper;

c) an outer sole attached to the upper on the other side;

d) an insole gasket material positioned between the inner sole and the outer sole and being constructed and arranged to cover the portion on the underside of the foot not covered by the upper, said insole gasket material joined to said upper in waterproof relationship;

e) said insole gasket material comprising a textile material coated with a continuous layer of an organic thermoplastic polymer, and being waterproof, flexible, conformable and stiff.

By stiff is meant that the gasket material is bendable, but only upon the application of force.

The textile material is preferably either a foamed textile or a nonwoven. The textile material is preferably a polyester nonwoven with a weight of greater than 2.5 oz/yd$^2$, and preferably less than 5.0 oz/yd$^2$, and having fibers of 2.0–5.0 denier per filament, such that the polyester nonwoven has a cantilever extension of greater than 5 inches as per FTM 5206, Fed STD-191A, section 4.

The organic thermoplastic polymer preferably has a melting point of between 45° C. and 75° C., preferably 55°–65° C. The organic thermoplastic polymer is preferably a polycaprolactone of molecular weight greater than about 30,000 or a polyurethane having polycaprolactonediol units of molecular weight greater than about 2000. One useful polyurethane is made of units of 4,4'-diphenyl methylene diisocyanate, the polycaprolactanediol, and 1,4-butanediol.

The thermoplastic coating is preferably a coating of polycaprolactone.

DETAILED DESCRIPTION OF THE INVENTION

Figure 1:
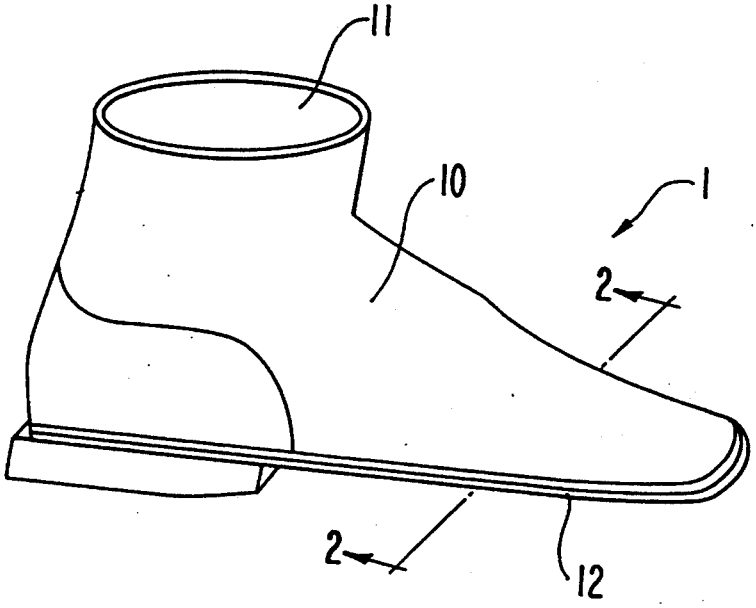
FIG. 1 is a perspective view of a shoe.
Figure 2:
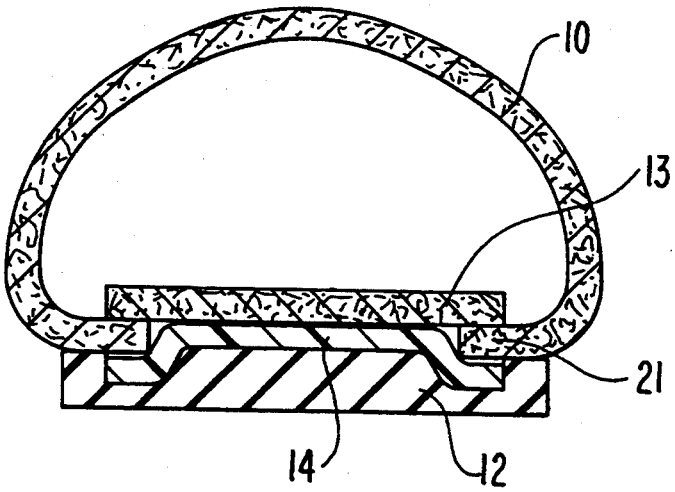
FIG. 2 is a cutaway view of the shoe viewed looking at the section 2—2 of FIG. 1.

FIG. 1 shows a shoe construction 1 having an upper section 10 and a top opening 11 and outer sole 12. Referring to FIG. 2, there is shown upper section 10, inner sole 13, outer sole 12 and insole gasket strip 14.

The upper is made of a waterproof construction. It can be leather or canvas usually with a soft fabric backing; or, it can be a laminate in which one layer comprises a waterproof, breathable membrane.

By "breathable" is meant that the membrane allows passage of water vapor. The membrane is ordinarily laminated on one or both sides to a protective material such as a fabric, e.g., a knit or woven material. The waterproof, breathable membrane can be made of any such known material, for example, GORE-TEX® membrane, which is a porous, expanded polytetrafluoroethylene (PTFE) membrane in which a sheet of PTFE has been stretched to form a microstructure comprised of nodes interconnected by fibrils, Sympatex® film which is described in U.S. Pat. No. 4,493,870 and is a polyester, and the like.

Figure 3:
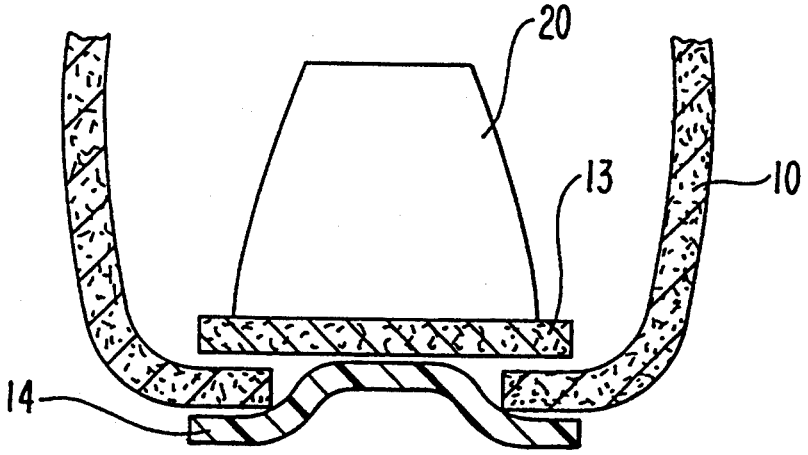
FIG. 3 is a cutaway view along line 2—2 where the shoe is being formed on a last.
Figure 4:
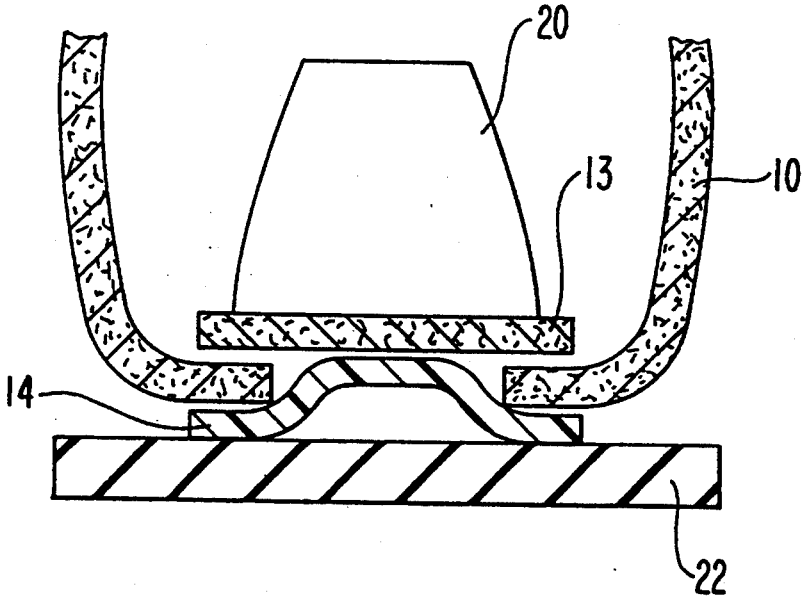
FIG. 4 is the same view as FIG. 3 but depicts a later step in the last procedure.
Figure 5A:
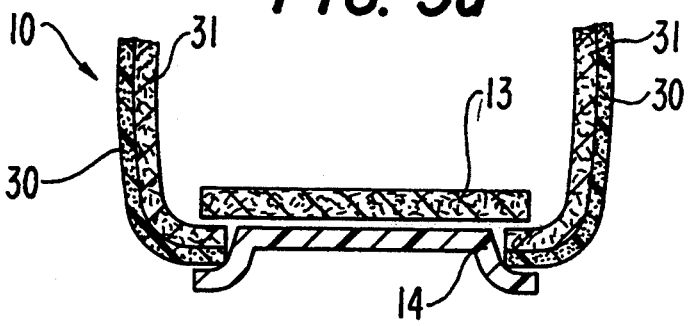
FIG. 5 shows various constructions in parts a, b, c, d, of shoes where the insole, insole gasket and upper join.
Figure 5B:
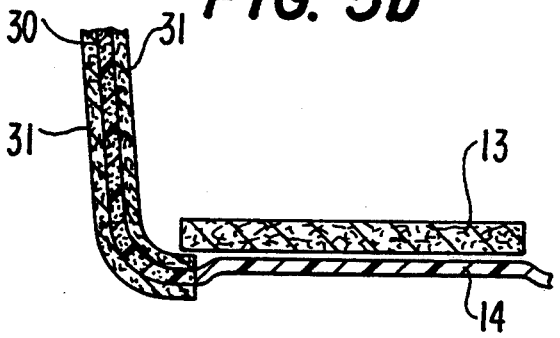
Figure 5C:
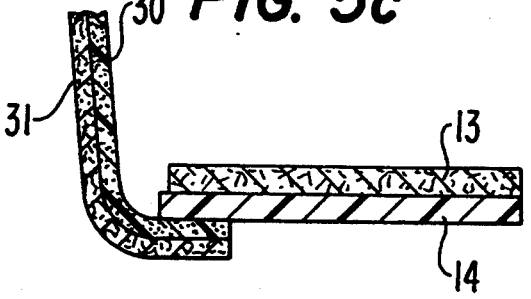
Figure 5D:
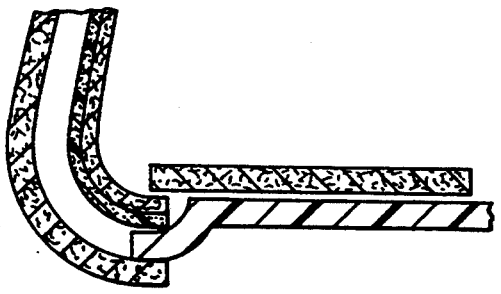

The upper 10, whether made of a single material or made of a laminate, is pulled around a form 20 commonly known as a shoe last to which an inner sole board 13 is attached. The inner sole is cemented on its bottom to the top side of the flange portion 21 of the upper, as shown in FIG. 3. The insole gasket strip 14 is then applied and adhered by heating to 50°–65° C., as shown in FIG. 4. The outer sole 22 is then applied to complete the shoe.

An inventive feature of the invention is insole gasket strip 20. It is comprised of a strip of a polyester nonwoven uniformly coated with a polycaprolactone adhesive to result in a stiff non-wrinkling waterproof insole gasket strip. In order to result in a stiff, non-wrinkling strip the polyester should weight rat least 2.5 oz. per sq. yd. and preferably be made of a spun bonded polyester such as Reemay® polyester. The polycaprolactone, for the same reason, should have a melting point of between about 55° and 65° C. and be highly viscous and tacky when heat activated.

The insole gasket strip can be prepared by extending polycaprolactone, such as is obtained from Solvay Interox, Ltd., Capa 650 onto a nonwoven Reemay polyester such as Fischer Textiles Reemay 2033 polyester to form a strip 0.015–0.030 inches thick. In one embodiment of making a shoe using the insole gasket strip described in the proceeding sentence, a waterproof liner made of an expanded porous PTFE membrane bonded between two knit layers was laminated to leather and formed into a shoe upper by sewing together two halves and covering the seams with waterproof seam tape. The upper was placed on a last and the inner sole applied in the usual lasting fashion. Then the insole gasket strip was applied by heating at 50°-65° C. with the thermoplastic coating adjacent the inner sole. The insole gasket strip conformed to the inner sole. An outer sole was then applied by conventional means.

The advantages of this new gasket are numerous. It is a stand alone construction, i.e., stiff and non-curling, in both tacky and cool state, and easy to handle and apply. It contains a preapplied adhesive and thus there is no solvent present during the lasting procedure. It conforms well, and is high strength, but of low mass.

The manner in which the insole gasket is affixed to the upper in waterproof fashion and in relation to the inner sole will depend on the construction of the upper.

For example, various constructions are shown in FIGS. 5*a*, 5*b*, 5*c*, 5*d*. In these FIGS. the upper 10 is a laminate of a waterproof, breathable membrane 30 and a fabric or leather protective cover 31. The inner sole is 13 and the insole gasket is 14. It is seen that regardless of the upper configuration, the insole gasket is always positioned to adjoin the membrane in the upper to provide a continuous waterproof seal.

We claim:

1. In a shoe, comprising:

(a) a waterproof upper extending partially under a foot;

(b) an inner sole having an under side and an upper side, attached on its under side to the portion of the upper extending partially under the foot;

(c) an outer sole attached to the waterproof upper; and (d) an insole gasket positioned between the inner sole and the outer sole and which contacts the area under the foot not covered by the waterproof upper; The improvement wherein the insole gasket consists essentially of a waterproof, flexible, stiff nonwoven polyester having a weight of 2.5 oz./yd.$^2$ or greater and being composed of fibers between 2 and 5 denier and having a cantilever extension greater than 5 inches as determined by FTM 5206, Fed. STD-191A, section 4; said nonwoven polyester being coated on one side with a polycaprolactone having a melting point between about 55° and 65° C. and a molecular weight greater than 30,000.

* * * * *